US010355381B2

(12) United States Patent
Ishikawa et al.

(10) Patent No.: US 10,355,381 B2
(45) Date of Patent: Jul. 16, 2019

(54) BOARD CONNECTOR

(71) Applicant: Sumitomo Wiring Systems, Ltd., Yokkaichi, Mie (JP)

(72) Inventors: Yoshiyuki Ishikawa, Mie (JP); Yasuaki Nakayama, Mie (JP); Kenji Makino, Mie (JP); Masami Sakai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 206 days.

(21) Appl. No.: 15/489,819

(22) Filed: Apr. 18, 2017

(65) Prior Publication Data

US 2017/0324176 A1 Nov. 9, 2017

(30) Foreign Application Priority Data

May 9, 2016 (JP) ..... 2016-093606

(51) Int. Cl.

| | |
|---|---|
| ***H01R 12/71*** | (2011.01) |
| ***H01R 12/70*** | (2011.01) |
| ***H01R 13/652*** | (2006.01) |
| ***H01R 13/10*** | (2006.01) |

(52) U.S. Cl.

CPC ..... *H01R 12/716* (2013.01); *H01R 12/7047* (2013.01); *H01R 13/10* (2013.01); *H01R 13/652* (2013.01)

(58) Field of Classification Search

CPC ..... H01R 12/712; H01R 12/7029; H01R 12/7047; H01R 12/716; H01R 13/10; H01R 13/652; H01R 13/73; H01R 13/74

See application file for complete search history.

(56) References Cited

U.S. PATENT DOCUMENTS 6,106,332 A * 8/2000 Souisa ..... H01R 12/7011 439/567
6,520,785 B2 * 2/2003 Hida ..... H01R 24/46 439/188
6,659,784 B1 * 12/2003 Klein ..... H01R 24/46 439/83
7,422,445 B2 * 9/2008 Cheng ..... H01R 12/721 439/567
7,845,981 B2 * 12/2010 Vanssay ..... H01R 13/65802 439/607.01

(Continued)

FOREIGN PATENT DOCUMENTS

JP 2003-22856 1/2003

*Primary Examiner* — Briggitte R. Hammond

(74) *Attorney, Agent, or Firm* — Gerald E. Hespos; Michael J. Porco; Matthew T. Hespos

(57) ABSTRACT

A board connector (10) includes a housing (20), fixing members (50) and a shield member (70). The housing (20) holds a terminal fitting (40). The fixing member (50) includes a housing fixing portion (51) to be fixed to the housing (20) and a board fixing portion (52) to be fixed to a circuit board (90) while being electrically connected to the circuit board (90). The shield member (70) includes mounting portions (75) to be mounted on the housing (75) and covering portions (77) for covering outer side surfaces of the fixing members (50) in a mounting direction of the mounting portions (75), and the covering portions (77) include contact portions (81) configured to come into contact with the outer side surfaces of the fixing members (50).

7 Claims, 7 Drawing Sheets

(56) References Cited

U.S. PATENT DOCUMENTS

2002/0081900 A1* 6/2002 Yu ..... H01R 12/7029
439/567
2015/0207269 A1* 7/2015 Sha ..... H01R 12/707
439/83

* cited by examiner

BOARD CONNECTOR

BACKGROUND

1. Field of the Invention

The invention relates to a board connector.

2. Description of the Related Art

Japanese Unexamined Patent Publication No. 2003-22856 (FIG. 6) discloses a connector with a housing for holding a contact (terminal fitting) and a metal material (shield member) surrounding the housing. The metal material includes a projecting portion projecting from an end surface of the housing. The projecting portion of the metal material is fit into a fitting hole formed on a printed board and, associated with that, the housing is fixed to the printed board. Further, the projecting portion of the metal material is connected electrically to a printed wiring formed on the printed board and connected to ground.

In the above case, the housing includes a fixing part for the housing and a fixing part (projecting portion) for the printed board and a relative positional relationship of both fixing parts need to be strictly determined. If the positional relationship of both fixing parts of the metal material is not precise, the housing cannot face a mating connector in a proper positional relationship when the metal material is fixed to the printed board, which may pose a problem for a subsequent connecting operation.

The invention was completed based on the above situation and aims to enable easy management of assembly dimensions of a board connector to be fixed to a circuit board and connected to ground.

SUMMARY

The invention is directed to a board connector with a housing for holding a terminal fitting. The board connector further also has a fixing member with a housing fixing portion to be fixed to the housing and a board fixing portion to be fixed to a circuit board while being electrically connected to the circuit board. The board connector further has a shield with a mounting portion to be mounted on the housing and a covering portion for covering an outer side surface of the fixing member in a mounting direction of the mounting portion. The covering portion includes a contact portion configured to contact the outer side surface of the fixing member.

The shield is ground-connected to the circuit board via the fixing member by having the board fixing portion fix the fixing member to the circuit board and bringing the contact portion of the covering portion into contact with the outer side surface of the fixing member. The covering portion covers the outer side surface of the fixing member in the mounting direction of the mounting portion when the mounting portion of the shield is mounted on the housing. Thus, the amount that the covering portion covers can be adjusted according to how much the mounting portion is mounted, and assembly dimensions between the shield and the fixing member can be managed easily.

The shield may include a deflection-deformable ground connecting portion. Thus, connection to a casing made of metal or the like can be maintained satisfactorily by the deflection and deformation of the ground connecting portion even if a mounted position of the mounting portion with respect to the housing is not determined to be constant.

The housing may have a rectangular tube shape with four side walls surrounding the terminal fitting. A connecting direction to a mating connector is substantially perpendicular to a plane direction of the circuit board. Two first walls facing each other include a mounting receiving portion into which the mounting portion is to be mounted and two second walls facing each other include a fixing receiving portion to which the housing fixing portion is to be fixed. Thus, the four side walls of the housing in the board connector of a so-called vertically fitting type can be utilized effectively rather than being left unused.

DETAILED DESCRIPTION

Figure 1:
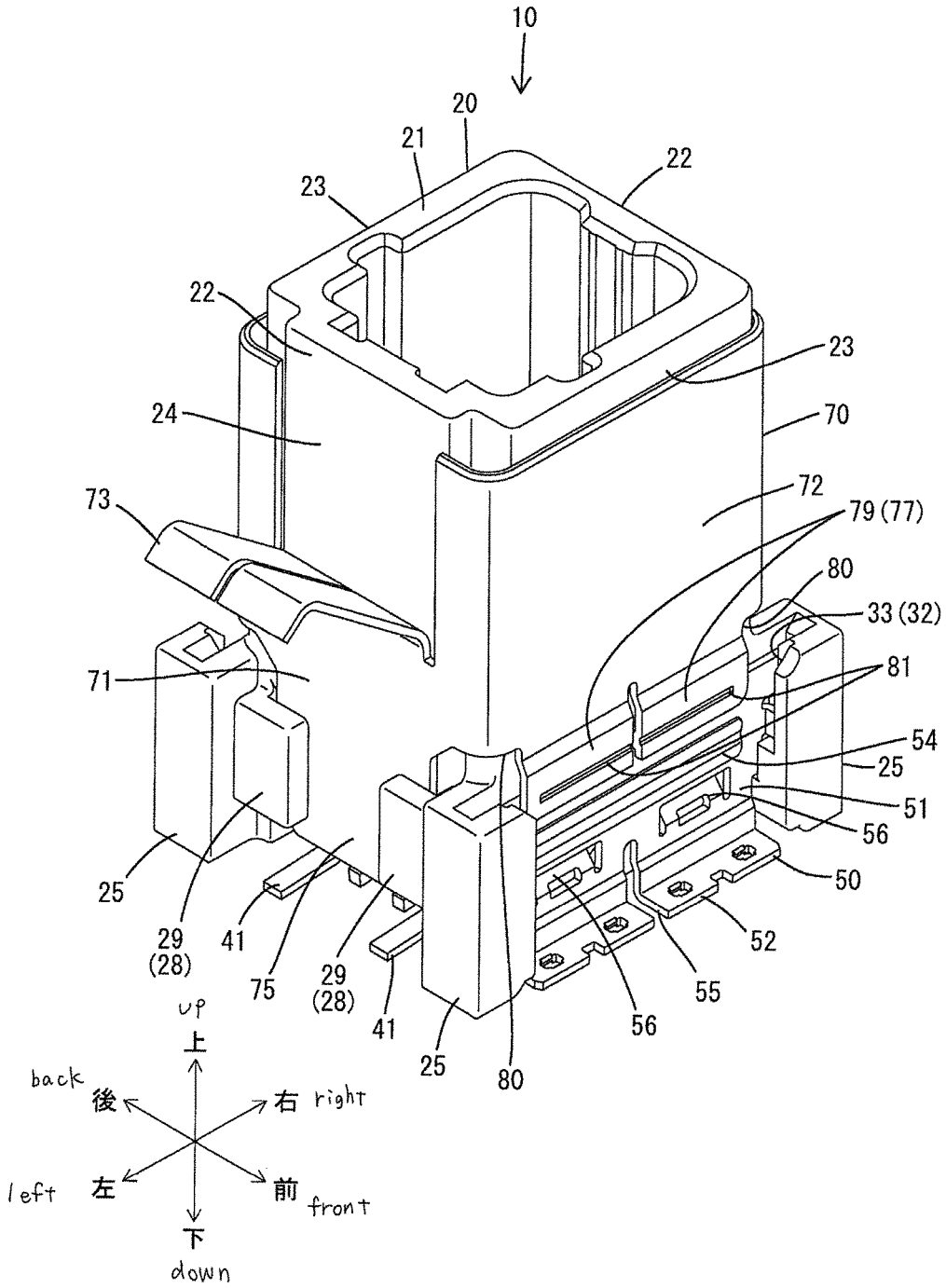
FIG. 1 is a perspective view of a board connector of one embodiment of the invention.
Figure 2:
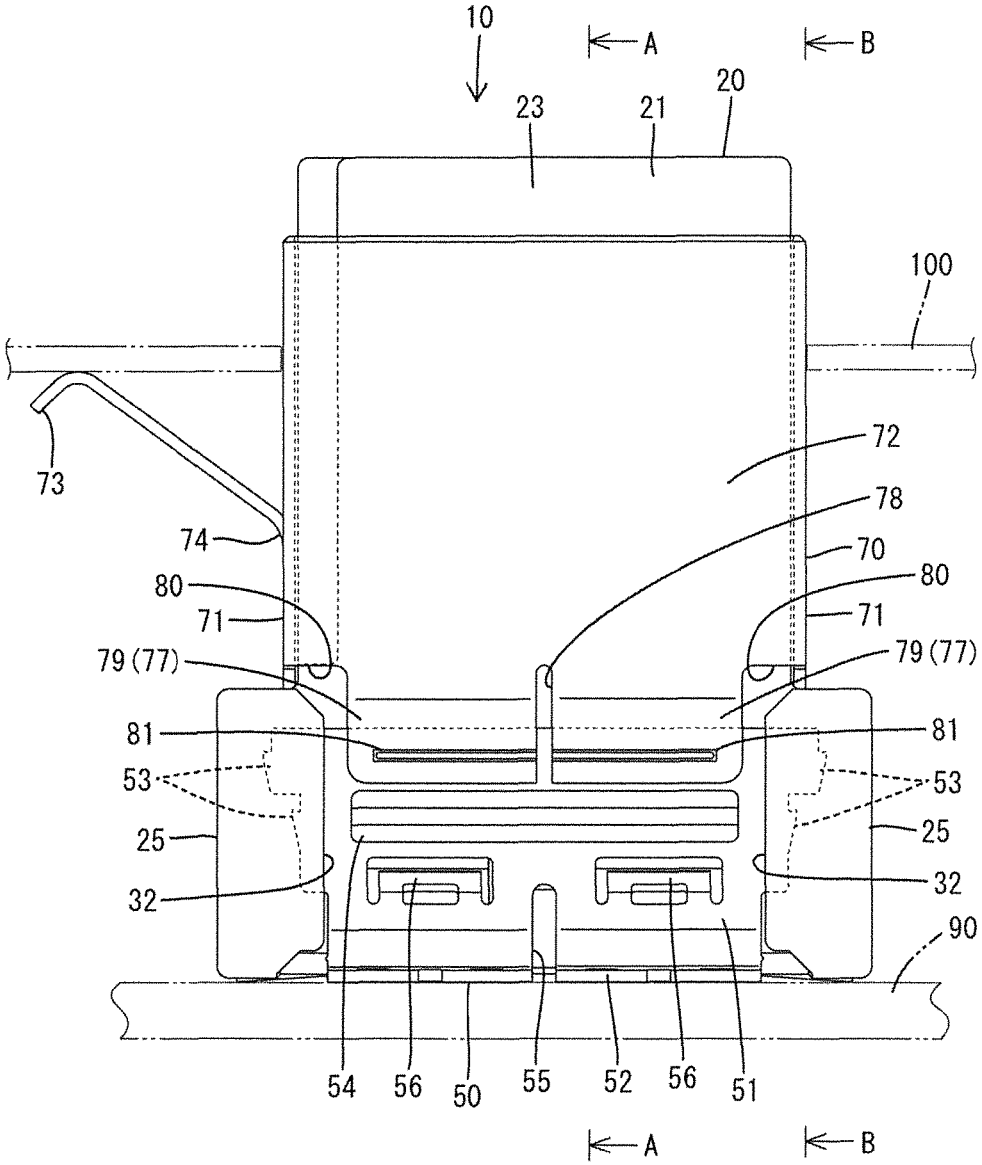
FIG. 2 is a front view of the board connector.
Figure 3:
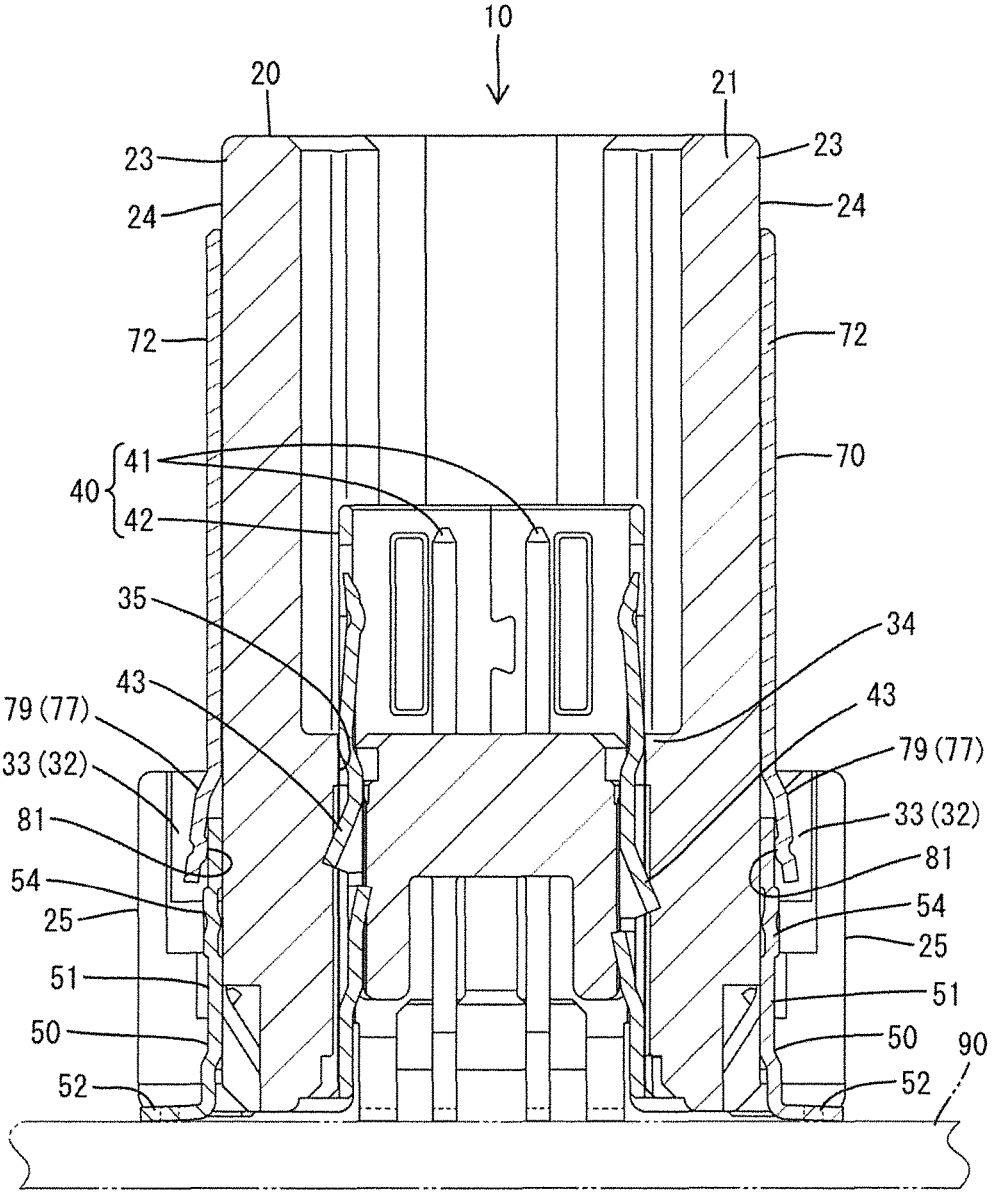
FIG. 3 is a section along A-A of FIG. 2.

A board connector in accordance with an embodiment is identified by the numeral 10 in FIGS. 1 to 4 and 7. The board connector 10 includes a housing 20 made of synthetic resin, fixing members 50 made of metal and a shield 70 made of metal. As shown in FIGS. 2 and 3, the housing 20 is fixed to a printed circuit board 90 via the fixing members 50. Further, a mating connector (not shown) is fit into the housing 20 in a direction substantially perpendicular to a plane direction of the circuit board 90. Note that, in the following description, a vertical direction is substantially perpendicular to the plane direction of the circuit board 90 and a vertical direction in figures excluding FIG. 6, a lateral direction is a lateral direction of FIGS. 2 and 7 and a front-rear direction is a lateral direction of FIGS. 3 and 4. The respective directions are shown in FIG. 1.

Figure 5:
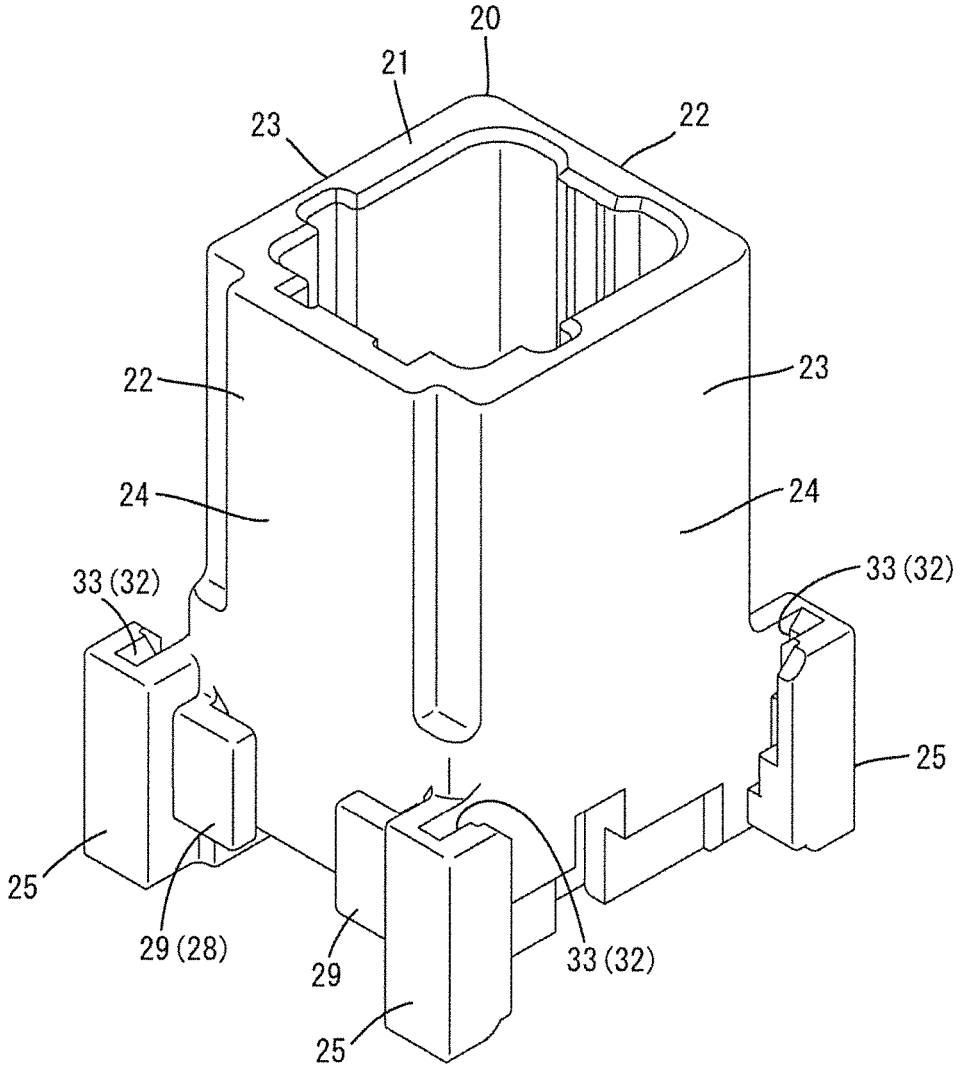
FIG. 5 is a perspective view of a housing.
Figure 6:
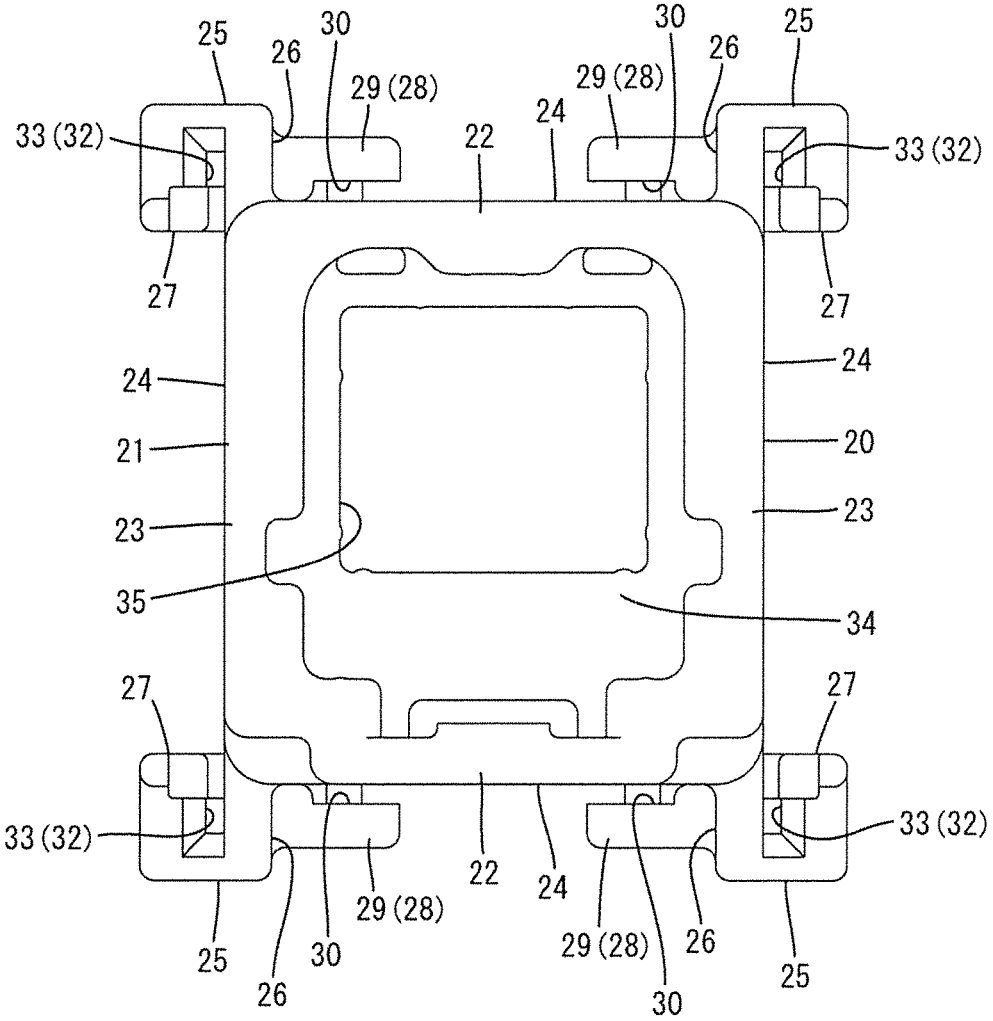
FIG. 6 is a plan view of the housing.

As shown in FIGS. 5 and 6, the housing 20 includes a receptacle 21 in the form of a rectangular upwardly open tube. The receptacle 21 includes four side walls for surrounding a terminal fitting 40 (see FIG. 3) to be described later. Specifically, as shown in FIG. 1, the receptacle 21 includes two first walls 22 facing each other in the lateral direction and two second walls 23 facing each other in the front-rear direction. Front and rear ends of the first walls 22 and left and right ends of the second walls 23 are coupled integrally to configure four corners of the receptacle 21. Further, the first walls 22 and the second walls 23 have outer wall surfaces 24 constituting outer side surfaces of the receptacle 21, rising from a surface of the circuit board 90 and extending along the vertical direction.

A projection 25 is provided on the lower end of each of the four corners of the receptacle 21. Each projection 25 defines a rectangular column extending in the vertical direction and is formed so that the lower end thereof is lower than a lower end of a body part (part excluding each projecting portion 25) of the receptacle 21. As shown in FIG. 6, the respective projections 25 have first surfaces 26 projecting in the lateral direction from both front and rear ends of the first walls 22 and facing each other in the front-rear direction and second surfaces 27 projecting in the front-rear direction from left and right sides of the second walls 23 and facing each other in the lateral direction.

Figure 4:
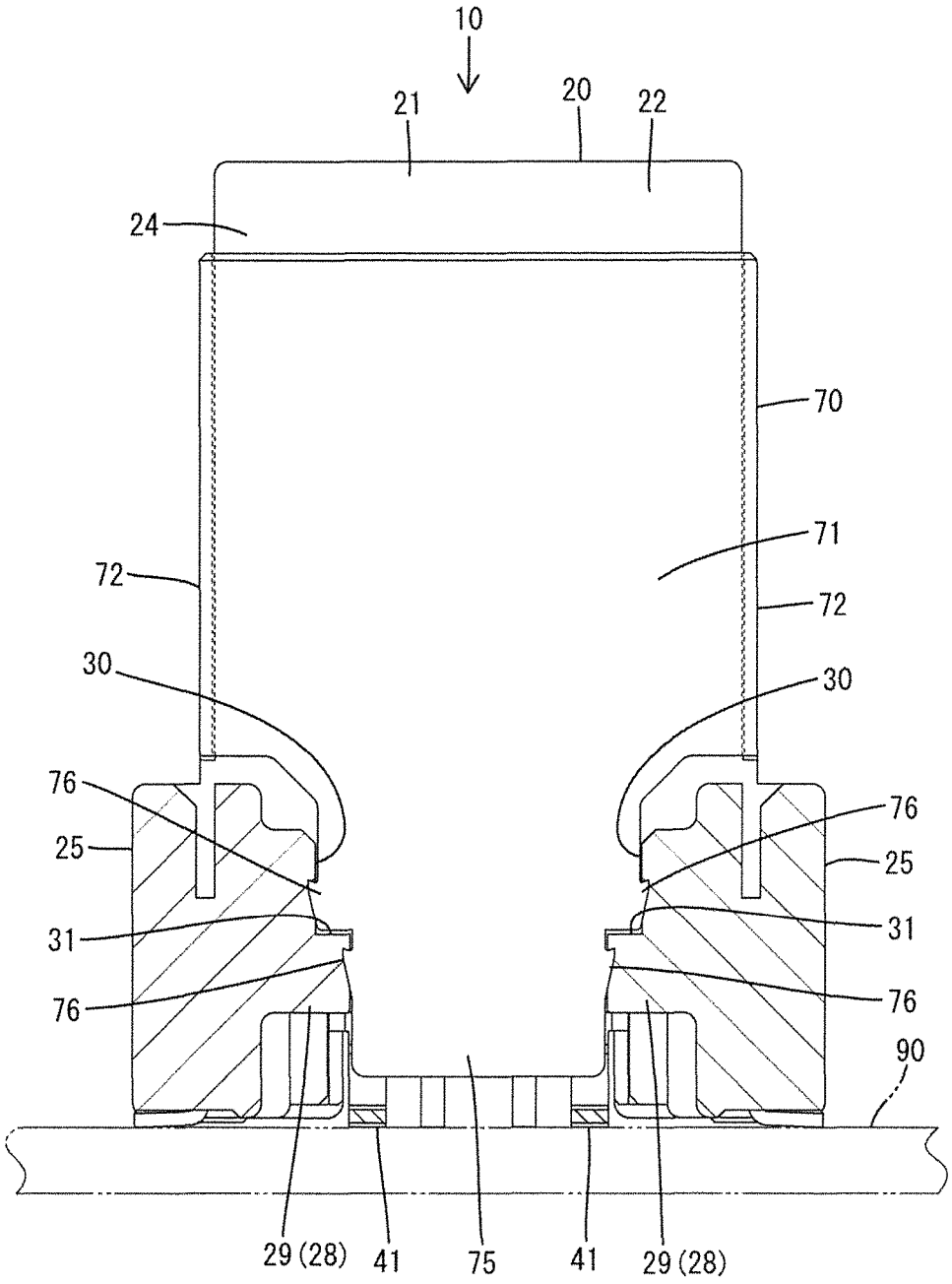
FIG. 4 is a section along B-B of FIG. 2.

Mounting receiving portions 28 are provided on lower parts of both first walls 22. Each mounting receiving portion 28 is defined by protruding portions 29 protruding in directions toward each other from the first walls 26 of the respective projections 25 and the outer surface 24 of the first wall 22. A slit-like mounting space 30 is open up between the outer surface 24 of the first wall 22 and the protruding portions 29. As shown in FIG. 4, a step 31 is provided at a vertically intermediate position of the inner back surface of the mounting space 30 and an upper side above the step 31 is wider in the front-rear direction than a lower side below the step 31. A later-described mounting portion 75 of the shield member 70 is press-fit and mounted into the mounting receiving portion 28.

Fixing receiving portions 32 are provided on lower end parts of both second walls 23. Each fixing receiving portion 32 is defined between receiving grooves 33 recessed on the second surfaces 27 of the respective projections 25 and the outer surface 24 of the second wall 23. Each receiving groove 33 is arranged within a wall thickness of the projection 25 and is in the form of a vertical slit groove that is open on an upper end. A step similar to the step 31 also is provided on the inner back surface of the receiving groove 33. A later-described housing fixing portion 51 of the fixing member 50 is press-fit and mounted into the fixing receiving portion 32.

As shown in FIG. 6, a terminal holding portion 34 is provided by padding an inner side surface of each of the first walls 22 and the second walls 23. A holding space 35 for holding the terminal fitting 40 is formed in a central part of the terminal holding portion 34.

The terminal fitting 40 is made of conductive metal and includes, as shown in FIG. 3, a plurality of pin-like inner conductors 41 and an outer conductor 42 in the form of a rectangular tube surrounding each inner conductor 41. The inner conductor 41 includes a part projecting into the receptacle 21 and a part arranged along the surface of the circuit board 90 and electrically connected to the circuit board 90. The outer conductor 42 includes resilient locking portions 43 to be locked resiliently to surfaces of the holding space 35 of the terminal holding portion 34. The terminal fitting 40 is connected electrically to a mating terminal fitting (not shown) held in the mating connector as the housing 20 is fit to the mating connector.

The fixing member 50 is a flat plate and, as shown in FIGS. 2 and 3, includes the housing fixing portion 51 arranged vertically and a board fixing portion 52 protruding substantially at a right angle from the lower end of the housing fixing portion 51 to define an L-shape in a side view. The fixing member 50 is fixed to the fixing receiving portion 32 of the receptacle 21 via the housing fixing portion 51 and fixed to the circuit board 90 via the board fixing portion 52. In this case, the housing fixing portion 51 is arranged along the outer surface 24 of the second wall 23 and the board fixing portion 52 is arranged along the surface of the circuit board 90 (see FIG. 3).

As shown in FIG. 2, locking projections 53 are provided protrude toward both left and right sides on both left and right end parts of the housing fixing portion 51. A plurality of the locking projections 53 are arranged in upper and lower levels, and the locking projections 53 in the upper level protrude more than the locking projections 53 in the lower level. The respective locking projections 53 are inserted into the receiving grooves 33 of the fixing receiving portion 32 from above and bite into the inner back surfaces of the receiving grooves 33 to be locked.

A reinforcing portion 54 extends laterally on an upper end part of the housing fixing portion 51. The reinforcing portion 54 is a rib bulging away from the outer surface 24 of the second wall 23. Further, a laterally central part of the housing fixing portion 51 is cut to provide a groove 55 extending from a lower end part of the housing fixing portion 51 to the board fixing portion 52. The groove 55 is open on an protruding end of the board fixing portion 52 and the board fixing portion 52 is divided laterally into left and right parts via the groove 55. Further, as shown in FIG. 1, the housing fixing portion 51 is provided with two cut-and-raised portions 56 formed by cutting the outer wall surface 24 of the second wall portion 23 and raising the cut parts at both left and right sides of the groove 55 and below the reinforcing portion 54.

As shown in FIG. 1, the shield 70 is a rectangular tube surrounding the receptacle 21 over the entire periphery and includes two first shield walls 71 for covering the outer surfaces 24 of the first walls 22 and two second shield walls 72 for covering the outer surfaces 24 of the second walls 23. Both front and rear ends of the first shield walls 71 and both left and right ends of the second shield walls 72 are coupled integrally, thereby configuring four corners of the shield 70. This shield 70 is formed by bending one conductive metal plate into a rectangular tube.

One of the first shield walls 71 is provided with a ground connecting portion 73 that is bent away from the outer surface 24 of the first wall 22. As shown in FIG. 2, the ground connecting portion 73 is cantilevered obliquely out from a fulcrum 74 that is at a substantially vertical center of the first shield wall 71, and is deflectable and deformable about the fulcrum 74. A tip part of the ground connecting portion 73 resiliently contacts a casing 100 made of metal to be ground-connected.

As shown in FIG. 4, the mounting portions 75 are provided on lower parts of the first shield walls 71. Each mounting portion 75 is a flat plate having a smaller width in the front-rear direction in the lower end part of the first shield wall portion 71 than an upper part and has a basic structure common to the housing fixing portion 51 of the fixing member 50. Specifically, the mounting portion 75 is arranged along the outer surface of the first shield wall 71 and projections 76 in upper and lower levels protrude toward both left and right sides on both left and right end parts of the mounting portion 75. The respective projections 76 are inserted into the mounting space 30 of the mounting receiving portion 28 from above and bite into the inner back surface of the mounting space 30 to be locked. Note that the width of the mounting portion 75 in the front-rear direction is smaller than a width of the housing fixing portion 51 in the lateral direction.

As shown in FIGS. 2 and 3, covering portions 77 are provided on lower parts of the second shield walls 72. Each covering portion 77 is a flat plate having a smaller width in the lateral direction in the lower part of the second shield wall 72 than an upper part and hangs down after being bent away from the outer surface 24 of the second wall 23 (see FIG. 3). As shown in FIG. 2, a slit groove 78 extends along the vertical direction in a laterally central part of the covering portion 77. The covering portion 77 has divided pieces 79 on left and right sides across the slit groove 78. The divided pieces 79 are deflectable and deformable with upper end parts (lower end part of the second shield wall 72) as fulcrums. Note that, as shown in FIGS. 1 and 2, downwardly open cuts 80 are provided between the covering portions 77 and the mounting portions 75 at the four corners of the shield 70. When the shield 70 is mounted on the receptacle 21, the projections 25 are arranged inside the cuts 80 so that the shield 70 does not interfere with the projections 25.

As shown in FIGS. 2 and 3, the divided pieces 79 of the covering portion 77 are provided with contact portions 81. The contact portions 81 are in the form of ribs extending in the lateral direction while bulging inward of the divided pieces 79 and continuously arranged across the slit groove 78 at the same height on lower end parts of the divided pieces 79.

The divided pieces 79 of the covering portion 77 are arranged to cover the outer surface of the housing fixing portion 51 of the fixing member 50. At this time, after the divided pieces 79 are deflected, the contact portions 81 resiliently contact the outer side surface of the housing fixing portion 51 to electrically connect the shield 70 to the fixing member 50 (see FIG. 3).

Next, functions of the board connector 10 of this embodiment are described.

In assembling, the housing fixing portions 51 of the fixing members 50 are inserted respectively in and fixed to the corresponding fixing receiving portions 32 from above along the outer surfaces 24 of the second walls 23. The shield 70 then is fit and mounted externally on the receptacle 21 from above. When the shield 70 is mounted on the receptacle 21, the two mounting portions 75 are inserted into the corresponding mounting receiving portions 28 from above along the outer surfaces 24 of the first walls 22 (see FIG. 4). A proper vertical mounted position of the fixing member 50 in the mounting receiving portion 28 is set when each projection 76 is stopped in contact with the step 31.

The covering portions 77 cover the respective outer side surfaces of upper parts of the corresponding housing fixing portions 51 from above (in a mounting direction of the mounting portions 75) when the shield 70 is mounted on the receptacle 21, and the contact portions 81 resiliently contact the outer side surfaces of the housing fixing portions 51 (see FIGS. 1 to 3). The contact portions 81 contact the upper end parts of the outer side surfaces of the housing fixing portions 51, which are above the reinforcing portions 54, along the lateral direction. The amount by which the outer side surfaces of the housing fixing portions 51 are covered by the covering portions 77 is determined by how much the shield 70 is mounted into the mounting receiving portions 28. Similarly, contact positions of the contact portions 81 with the outer side surfaces of the housing fixing portions 51 also are determined by how much the fixing members 50 are mounted into the fixing receiving portion 32 are variably adjusted in the vertical direction.

Figure 7:
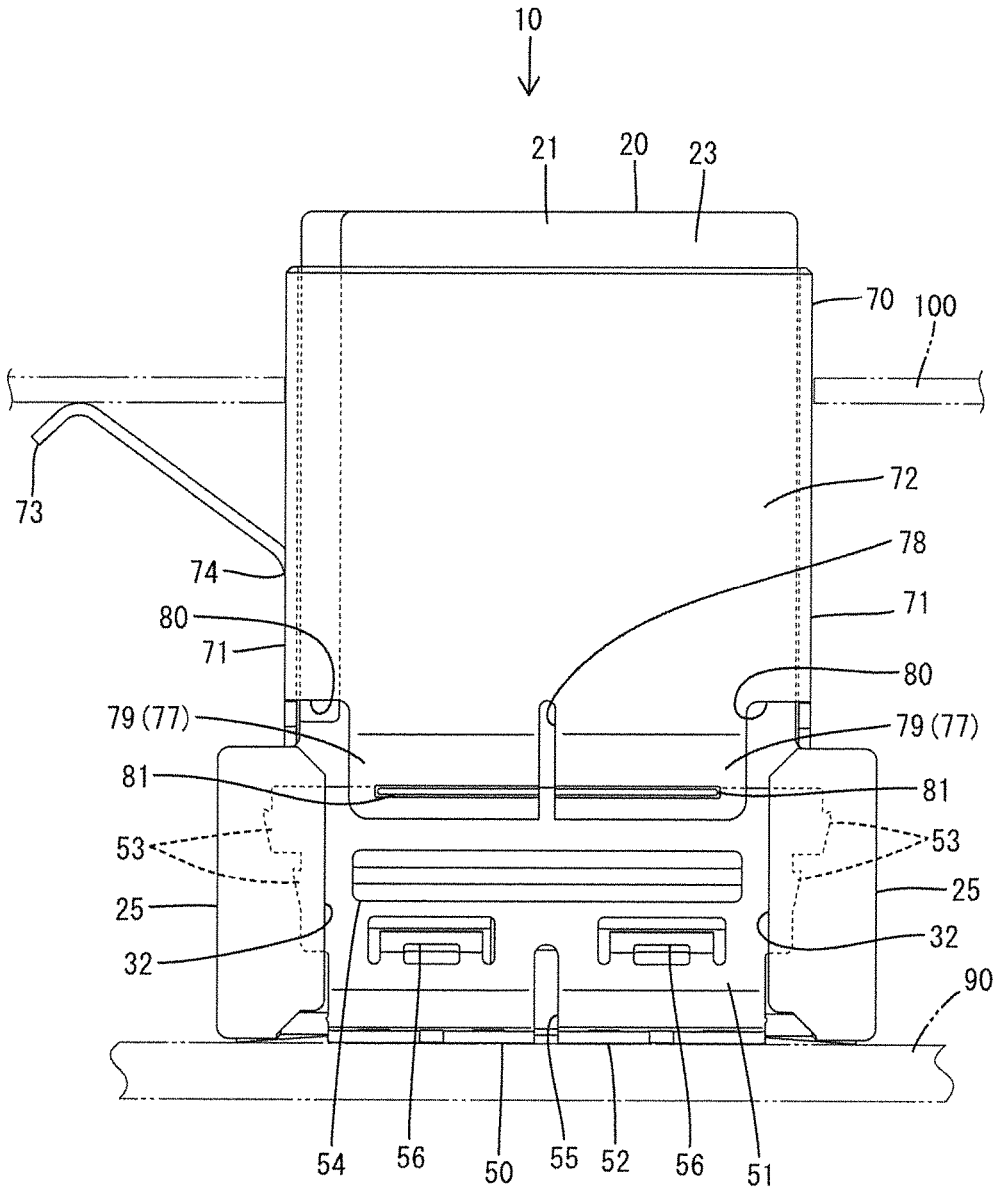
FIG. 7 is a view, corresponding to FIG. 2, showing a state where a covering portion of a shield covers an outer side surface of a fixing member to a small extent.

For example, if the mounting portions 75 of the shield 70 are mounted more shallowly into the mounting receiving portions 28 than in the case of FIG. 2 and the outer side surfaces of the housing fixing portions 51 are covered to a smaller extent by the covering portions 77, as shown in FIG. 7, the contact portions 81 contact the vicinities of the upper ends of the outer side surfaces of the housing fixing portions 51. Thus, even if the mounting portions 75 are mounted into the mounting receiving portions 28 to a different extent, a state where the shield 70 and the fixing members 50 are held in contact via the contact portions 81 can be maintained satisfactorily.

After the fixing members 50 and the shield 70 are assembled with the housing 20 in this way, the housing 20 is supported on the circuit board 90 and the board fixing portions 52 of the fixing members 50 are soldered. In this way, the fixing members 50 are fixed to the circuit board 90 and the shield 70 is ground-connected to the circuit board 90 via the fixing members 50.

As described above, the board fixing portions 52 and the contact portions 81 of the covering portions 77 come into contact with the outer side surfaces of the fixing members 50 to fix the fixing members 50 to the circuit board 90. Thus, the shield 70 is ground-connected to the circuit board 90 via the fixing members 50. When the mounting portions 75 of the shield 70 are mounted on the receptacle 21 of the housing 20, the covering portions 77 cover the outer side surfaces of the fixing members 50 in the mounting direction of the mounting portions 75. Thus, the amount the covering portions 77 cover can be adjusted according to how much the mounting portions 75 are mounted and assembly dimensions between the shield 70 and the fixing members 50 can be managed easily.

Further, the shield member 70 includes the deflection-deformable ground connecting portion 73 to be ground-connected to the metal casing 100. Accordingly, even if the mounted positions of the mounting portions 75 with respect to the housing 20 are not determined to be constant, connection to the casing 100 can be maintained satisfactorily by the deflection and deformation of the ground connecting portion 73.

Furthermore, the housing 20 is formed into a rectangular tube shape by the four side walls surrounding the terminal fitting 40, a connecting direction to the mating connector is specified to be a direction substantially perpendicular to the plane direction of the circuit board 90 and the first walls 22 facing each other include the mounting receiving portions 28 into which the mounting portions 75 are to be mounted and the second walls 23 facing each other include the fixing receiving portions 32 to which the housing fixing portions 51 are to be fixed. Accordingly, all four side walls 22 and 23 of the housing 20 in the board connector 10 can be utilized effectively rather than being left unused.

Other embodiments of the present invention are briefly described.

The ground connecting portion may be omitted from the shield.

The circuit board may include fixing holes, the fixing members may include board fixing portions in the form of pins or pieces, and the board fixing portions may be inserted into the fixing holes of the circuit board, soldered and fixed and connected to ground.

The shield may be provided with only one mounting portion or covering portion.

The mounting portions of the shield may be mounted by being resiliently locked to the mounting receiving portions.

The invention is also applicable to a board connector of a horizontally fitting type whose housing is to be fit to a mating connector in a direction parallel to the plane direction of the circuit board.

LIST OF REFERENCE SIGNS

10 . . . board connector
20 . . . housing
21 . . . receptacle
22 . . . first wall
23 . . . second wall
28 . . . mounting receiving portion
32 . . . fixing receiving portion
40 . . . terminal fitting
50 . . . fixing member
51 . . . housing fixing portion

52 . . . board fixing portion
70 . . . shield
73 . . . ground connecting portion
75 . . . mounting portion
77 . . . covering portion
81 . . . contact portion
90 . . . circuit board

What is claimed is:

1. A board connector to be mounted on a circuit board, comprising:

a rectangular tubular housing configured to be connected to a mating connector along a direction perpendicular to a plane of the circuit board, the housing having two opposed first side walls each of which includes a mounting receiving portion and two opposed second side walls each of which includes a fixing receiving portion, the first and second walls being disposed for surrounding and holding a terminal fitting;

a fixing member including a housing fixing portion configured to be fixed to the fixing receiving portions of the housing and a board fixing portion to be fixed to a circuit board while being electrically connected to the circuit board; and a shield including a mounting portion configured to be mounted on the mounting receiving portions of the housing and a covering portion for covering an outer side surface of the fixing member in a mounting direction of the mounting portion, the covering portion including a contact portion configured to come into contact with the outer side surface of the fixing member.

2. The board connector of claim 1, wherein the shield includes a deflectable and deformable ground connecting portion.

3. The board connector of claim 2 wherein the ground connecting portion is formed of a side of the shield that includes the mounting portion.

4. The board connector of claim 3 wherein the ground connecting portion is cantilevered obliquely away from the mounting portion and away from the circuit board.

5. The board connector of claim 1 wherein the contact portion is on a part of the covering portion that is resiliently deflectable and deformable and are configured for resiliently contacting outer side surfaces of the housing fixing portion.

6. The board connector of claim 5, wherein the part of the covering portion that is resiliently deflectable and deformable includes at least one rib projecting toward the housing fixing portion.

7. A board connector to be mounted on a circuit board that is disposed in a casing, comprising:

a housing with a receptacle facing an opening in the casing and away from the circuit board when the board connector is mounted on the circuit board;

a fixing member including a housing fixing portion fixed to the housing and a board fixing portion to be fixed to a circuit board while being electrically connected to the circuit board; and a shield including a mounting portion mounted on the housing and a covering portion for covering an outer side surface of the fixing member in a mounting direction of the mounting portion, the covering portion including a contact portion configured to come into contact with the outer side surface of the fixing member, the shield further including a ground connecting portion cantilevered obliquely away from the housing and toward the casing for resiliently contacting a surface of the casing that faces toward the circuit board, the resilient contact of the ground connecting portion being achieved for each of plural mounting positions of the shield on the housing.

* * * * *